US007055480B2

(12) United States Patent
Kusaka et al.

(10) Patent No.: US 7,055,480 B2
(45) Date of Patent: Jun. 6, 2006

(54) VALVE GEAR OF INTERNAL COMBUSTION ENGINE

(75) Inventors: Yasushi Kusaka, Susono (JP); Toshiaki Asada, Mishima (JP); Shuichi Ezaki, Susono (JP); Kimitoshi Tsuji, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/988,552

(22) Filed: Nov. 16, 2004

(65) Prior Publication Data

US 2005/0098129 A1 May 12, 2005

(30) Foreign Application Priority Data

Aug. 12, 2003 (JP) ..... 2003-409333

(51) Int. Cl.
*F01L 1/04* (2006.01)

(52) U.S. Cl. ..... 123/90.6; 123/90.11; 123/90.31; 123/90.16

(58) Field of Classification Search ..... 123/90.6, 123/90.11
See application file for complete search history.

(56) References Cited

U.S. PATENT DOCUMENTS

| | | | | |
|---|---|---|---|---|
| 5,040,500 | A * | 8/1991 | Reece | 123/90.27 |
| 5,107,805 | A * | 4/1992 | Butterfield et al. | 123/90.17 |
| 5,873,335 | A | 2/1999 | Wright et al. | |
| 5,960,755 | A | 10/1999 | Diggs et al. | |
| 6,705,256 | B1 * | 3/2004 | Yamaki et al. | 123/90.11 |
| 2004/0118367 | A1 * | 6/2004 | Ezaki et al. | 123/90.11 |

FOREIGN PATENT DOCUMENTS

| | | |
|---|---|---|
| FR | 2 608 675 | 6/1988 |
| JP | 59-068509 | 4/1984 |
| JP | 08-177536 | 7/1996 |

* cited by examiner

*Primary Examiner*—Thomas Denion
*Assistant Examiner*—Kyle M. Riddle
(74) *Attorney, Agent, or Firm*—Oliff & Berridge, PLC

(57) ABSTRACT

There is provided a valve gear of an internal combustion engine, comprising a cam mechanism for converting rotational motion of an electric motor into linear motion to drive a valve for opening and closing a cylinder against a valve spring, and a torque reduction mechanism for adding an opposite torque, which serves so as to reduce a torque applied to the cam mechanism from the valve spring at the time of driving the valve, to the cam mechanism.

10 Claims, 9 Drawing Sheets

VALVE GEAR OF INTERNAL COMBUSTION ENGINE

BACKGROUND OF THE INVENTION

1. Field of the Invention

The present invention relates to a valve gear of an internal combustion engine.

2. Description of the Related Art

An intake valve and an exhaust valve of an internal combustion engine are driven so as to be opened and closed by a power taken out from a crank shaft of the internal combustion engine. In recent years, it is tried to drive the intake valve and the exhaust valve by an electric motor to open and close the valves. For example, there has been proposed a valve gear which opens and closes the intake valve by rotating a cam shaft by a stepping motor (Japanese Patent Application Laid-Open (JP-A) No. 8-177536). In addition, JP-A No. 59-68509 exists as a prior art document relevant to the present invention.

When the intake valve and the exhaust valve are opened and closed by driving the cam mechanism by the electric motor, it is necessary to output a driving force against a torque applied to the cam mechanism based on a repulsive force of a valve spring provided for each of the valves (hereinafter, this torque is referred to as a valve spring torque), from the electric motor. Accordingly, when the valve spring torque is increased, an increase of an electric power consumption and an increase of an electric motor rating are generated.

SUMMARY OF THE INVENTION

Accordingly, an object of the present invention is to provide a valve gear of an internal combustion engine which can restrict a rated power required for an electric motor for driving a cam mechanism and an electric power consumption thereof.

In order to achieve the object mentioned above, according to the present invention, there is provided a valve gear of an internal combustion engine comprising a cam mechanism for converting rotational motion of an electric motor into linear motion to drive a valve for opening and closing a cylinder against a valve spring, and a torque reduction mechanism for adding an opposite torque serving so as to reduce a torque applied to the cam mechanism from the valve spring at the time of driving the valve, to the cam mechanism.

In the valve gear according to the present invention, the torque periodically fluctuating in synchronous with the opening and closing motion of the valve is applied to the cam mechanism, at the time of opening and closing the valve against a reaction force of the valve spring. The torque reduction mechanism applies the opposite torque canceling the torque to the cam mechanism, whereby it is possible to reduce the torque applied as a load to the electric motor and is possible to restrict the fluctuation thereof.

In the valve gear according to the present invention, the torque reduction mechanism may comprise an opposite phase cam which rotates in an interlocking manner at a rotational speed of 1/N (where N is an integral number) times of the rotational speed of a cam in the cam mechanism and has a cam surface formed on a surface thereof, a cam holding member which is in contact with the cam surface, and an urging member which urges the cam holding member toward the cam surface of the opposite phase cam, and an outline of the cam surface on the opposite phase cam may be set such that an opposite torque canceling a valve spring torque applied to the cam mechanism based on the reaction force of the valve spring is applied to the opposite phase cam from the urging member. According to the structure mentioned above, it is possible to add the opposite torque canceling the valve spring torque, based on a simple structure of arranging the opposite phase cam, bringing the holding member into contact with the cam surface on the surface of the opposite phase cam and pressing by the urging member.

Further, the torque reduction mechanism may comprise an opposite phase cam which rotates in an interlocking manner at a rotational speed of 1/N (where N is an integral number) times of the rotational speed of a cam in the cam mechanism and has a cam surface formed on an outer periphery thereof, a cam holding member which is in contact with the cam surface, and an urging member which urges the cam holding member toward the cam surface on the opposite phase cam, and an outline of the cam surface on the opposite phase cam may be set such that an opposite torque canceling a combined torque obtained by combining a valve spring torque applied to the cam mechanism based on the reaction force of the valve spring and an inertia toque applied to the cam mechanism according to motion of the valve is applied to the opposite phase cam from the urging member. In this case, since the opposite torque is set taking the inertia torque into consideration, it is possible to restrict the fluctuation of the torque applied as the load to the electric motor smaller. Accordingly, it is possible to improve a control accuracy of the valve at the time of high rotation of the internal combustion engine when the inertia toque is particularly increased, and it is possible to accurately control an intake or exhaust property of the internal combustion engine to a target property. Even at the time of low rotation, it is possible to change an operation property of the intake valve or the exhaust valve in a more opening direction, thereby allowing an intake efficiency or an exhaust efficiency to sufficiently be improved at the time of low rotation.

In the valve gear according to the present invention, the cam surface to be provided on the opposite phase cam of the torque reduction mechanism can be characterized by a change property of the opposite torque applied according to the present invention. Namely, in the valve gear according to the present invention, the outline of the cam surface on the opposite phase cam may be set such that, the opposite torque applied from the urging member is applied in a direction of pushing out the opposite phase cam in the rotational direction during a period that the cam of the cam mechanism is positioned in a side that the cam is pushed back in an opposite direction to the rotational direction based on the reaction force of the valve spring, in making a position in the peripheral direction of the cam in the cam mechanism, at the time when the cam mechanism applies a maximum lift amount to the valve, to be a boundary, while the opposite torque is applied in a direction of pushing back the opposite phase cam in the opposite direction to the rotational direction during a period that the cam of the cam mechanism is positioned in a side that the cam is pushed out in the rotational direction based on the reaction force of the valve spring.

Further, particularly when the inertia torque is considered, the outline of the cam surface on the opposite phase cam may be set such that the opposite torque applied from the urging member is applied in a direction of pushing out the opposite phase cam in the rotational direction during a period that the cam in the cam mechanism is positioned in a side that the cam is pushed back in an opposite direction to the rotational direction based on the reaction force of the valve spring, in making a position in the peripheral direction of the cam in the cam mechanism, at the time when the cam mechanism applies a maximum lift amount to the valve, to be a boundary, while the opposite torque is applied in the direction of pushing back the opposite phase cam in the opposite direction to the rotational direction during a period that the cam of the cam mechanism is positioned in a side that the cam is pushed out in the rotational direction based on the reaction force of the valve spring, and such that the opposite torque relatively larger than the opposite torque required for canceling only the valve spring torque is applied to the opposite phase cam during a period that the cam of the cam mechanism is positioned in a range that the lift speed is increased, in making a position where the cam mechanism applies a maximum lift speed to the valve to be a boundary, while the opposite torque relatively smaller than the opposite torque required for canceling only the valve spring torque is applied to the opposite phase cam during a period that the cam of the cam mechanism is positioned in a range that the lift speed is reduced.

In the preferred embodiment according to the present invention, a plurality of intake or exhaust valves may be provided for one cylinder of the internal combustion engine, a plurality of cams for driving the valves of the same cylinder may be provided so as to rotatably be driven by a common cam shaft, and the opposite phase cam may commonly be provided for the cams. In this embodiment, the opposite phase cam may be arranged between the cams.

In the aspects mentioned above according to the present invention, the concept "canceling" includes both the case of reducing the torque applied to the cam mechanism by the opposite torque, and the case of completely canceling the torque.

According to the present invention, since the torque applied to the cam mechanism from the valve spring can be reduced by the opposite torque which the torque reduction mechanism applies to the cam mechanism, it is possible to reduce the torque applied to the electric motor as a load, and it is possible to restrict the fluctuation of the torque. Accordingly, the output required to the electric motor for driving the cam mechanism can be reduced, the electric power consumption of the electric motor can be restricted, and the rated output required for the electric motor can be lowered. Therefore, it is possible to use a compact electric motor in comparison with the case that the torque reduction mechanism is omitted.

DETAILED DESCRIPTION OF THE PREFERRED EMBODIMENTS

First Embodiment

Figure 1:
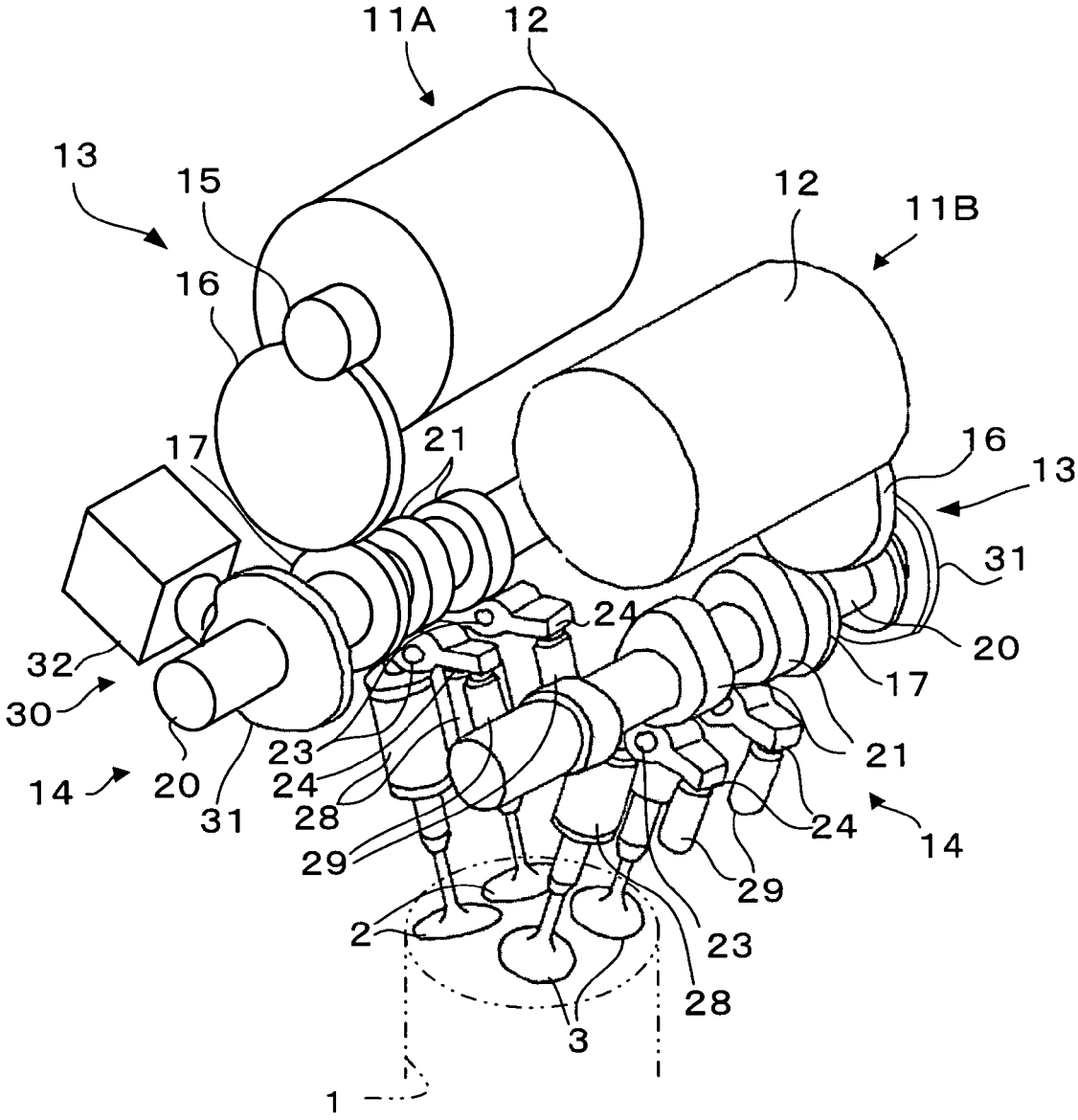
FIG. 1 is a perspective view showing a valve gear according to the present invention.

FIG. 1 shows an embodiment of a valve gear according to the present invention. Valve gears 11A and 11B in FIG. 1 are installed in a multiple cylinder reciprocal type internal combustion engine. In the internal combustion engine, two intake valves 2 of one cylinder 1 are driven by one valve gear 11A, and two exhaust valves 3 of the same cylinder 1 are driven so as to be opened and closed by another valve gear 11B. With regard to the other cylinders (not shown), the intake valves and the exhaust valves are driven so as to be opened and closed by the different valve gears 11A and 11B in the same manner. The valve gear 11A in an intake side and the valve gear 11B in an exhaust side basically have the same structure, and a description will be given below of the valve gear 11A in the intake side.

The valve gear 11A in the intake side is provided with an electric motor (hereinafter, referred to as a motor) 12 serving as a drive source, a gear train 13 corresponding to a transfer mechanism for transferring a rotational motion of the motor 12, and a cam mechanism 14 converting the rotational motion transferred from the gear train 13 into a linear opening and closing motion of the intake valve 2. As the motor 12, there is employed a DC brushless motor or the like in which a rotational speed can be controlled. The motor 12 incorporates a position detecting sensor (not shown) such as a resolver, a rotary encoder or the like for detecting a rotational position of the motor 12. The gear train 13 transfers the rotation of a motor gear 15 mounted to an output shaft (not shown) of the motor 12 to a cam driving gear 17 via an intermediate gear 16. The gear train 13 may be structured such that the motor gear 15 and the cam driving gear 17 are rotated at a uniform speed, or may be structured such that a speed of the cam driving gear 17 is increased or reduced with respect to the motor gear 15.

Figure 2:
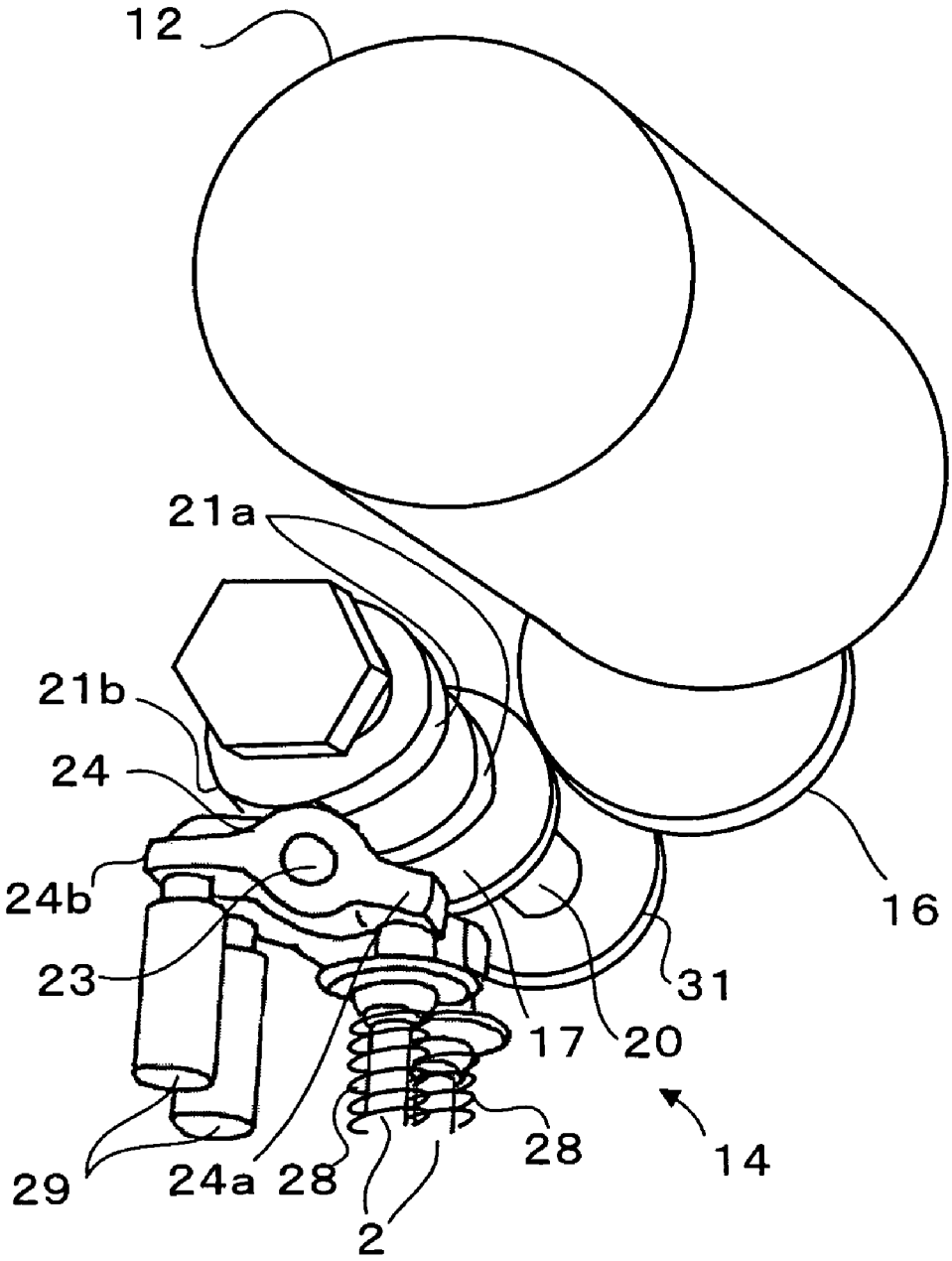
FIG. 2 is a perspective view showing a cam mechanism.

As is also shown in FIG. 2, the cam mechanism 14 is provided with a cam shaft 20 which is provided so as to be coaxially and integrally rotated with the cam driving gear 17, two cams 21 which are provided so as to be integrally rotated with the cam shaft 20, and a pair of rocker arms 24 which are supported so as to be swung around a rocker arm shaft 23 in correspondence to the respective cams 21. The cam 21 is formed as one kind of plate cam in which a nose 21*a* is formed by protruding a part of a circular arc base circle 21*b* coaxially formed with the cam shaft 20 toward an outer side in a radial direction. A profile of the cam 21 is set such that no negative curvature is generated around an entire periphery of the cam 21, that is, a convex curve is formed toward the outer side in the radial direction.

Each of the cams 21 is opposed to one end portion 24*a* of the rocker arm 24. Each of the intake valves 2 is urged to a side of the rocker arm 24 by a compression reaction force of a valve spring 28, whereby the intake valve 2 is closely attached to a valve seat (not shown) of an intake port, and the intake port is closed. The other end portion 24*b* of the rocker arm 24 is in contact with an adjuster 29. The adjuster 29 presses up the other end portion 24*b* of the rocker arm 24, the rocker arm 24 is kept in a state in which one end portion 24*a* is in contact with an upper end portion of the intake valve 2.

In the cam mechanism 14 mentioned above, when the rotational motion of the motor 12 is transferred to the cam shaft 20 via the gear train 13, the cam 21 is rotated integrally with the cam shaft 20, and the rocker arm 24 is oscillated around the rocker arm shaft 23 in a fixed range during a period that the nose 21*a* gets over the rocker arm 24. Accordingly, one end portion 24*a* of the rocker arm 24 is pressed down, and the intake valve 2 is driven so as to be opened and closed against the valve spring 28.

As shown in FIG. 1, a torque reduction mechanism 30 is provided in the valve gear 11A. The torque reduction mechanism 30 is provided for reducing a torque applied to the cam mechanism 14 based on a force which the valve spring 28 presses back the intake valve 2 in a closing direction (hereinafter, this torque is referred to as a valve spring torque). As in detail shown in FIG. 3, the torque reduction mechanism 30 is provided with an opposite phase cam 31 which can be integrally rotated with the cam shaft 20, and a torque applying apparatus 32 which is arranged so as to oppose to the opposite phase cam 31. An outer peripheral surface of the opposite phase cam 31 is structured as a cam surface 31*a*. The torque applying apparatus 32 is provided with a housing 33, a lifter 34 corresponding to a holding member which is received in the housing 33 in a state of being capable of protruding toward the opposite phase cam 31 from the housing 33, and a spring 35 corresponding to an urging member which is attached in a compressed state between the lifter 34 and the housing 33 and presses the lifter 34 to the cam surface 31*a* on the opposite phase cam 31.

Figure 4:
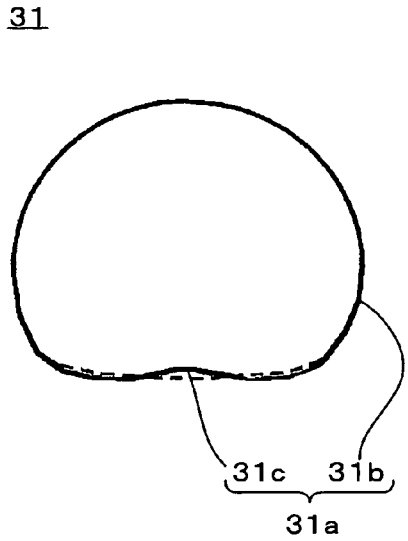
FIG. 4 is a view showing a profile of an opposite phase cam in FIG. 3.

As shown by a solid line in FIG. 4, the cam surface 31*a* of the opposite phase cam 31 is provided with a circular arc portion 31*b* which is extended while drawing a circular arc (called as a base circle) having a fixed radius and being coaxial with the cam shaft 20, and a back portion 31*c* which is backed to a center side from the circular arc portion 31*b*. A shape of the cam surface 31*a* (a cam profile) mentioned above is set based on a valve spring torque. A description of a design of the cam surface 31*a* will be given below.

A valve spring torque Tv (N·m) is calculated according to the following formula (1) on the assumption that the compression reaction force of the valve spring 28 is set to Fs (N), and a lift speed of the intake valve 2 at the time when the cam shaft 20 is rotated at a unit angle is set to Vv (m/rad).

$$Tv=Fs\times Vv \tag{1}$$

In this case, since the lift speed Vv is different according to the rotational speed of the internal combustion engine, it is necessary to use the lift speed Vv in any rotational speed representatively. Since the valve spring torque Tv is increased according to an increase of the lift speed Vv, it is desirable to employ the lift speed Vv at the time when the internal combustion engine is rotated at a preferably higher speed, in order to reduce an absolute load of the motor 12. It is optimum to employ the lift speed Vv at the time of a highest speed which is allowed in the internal combustion engine.

Figure 5:
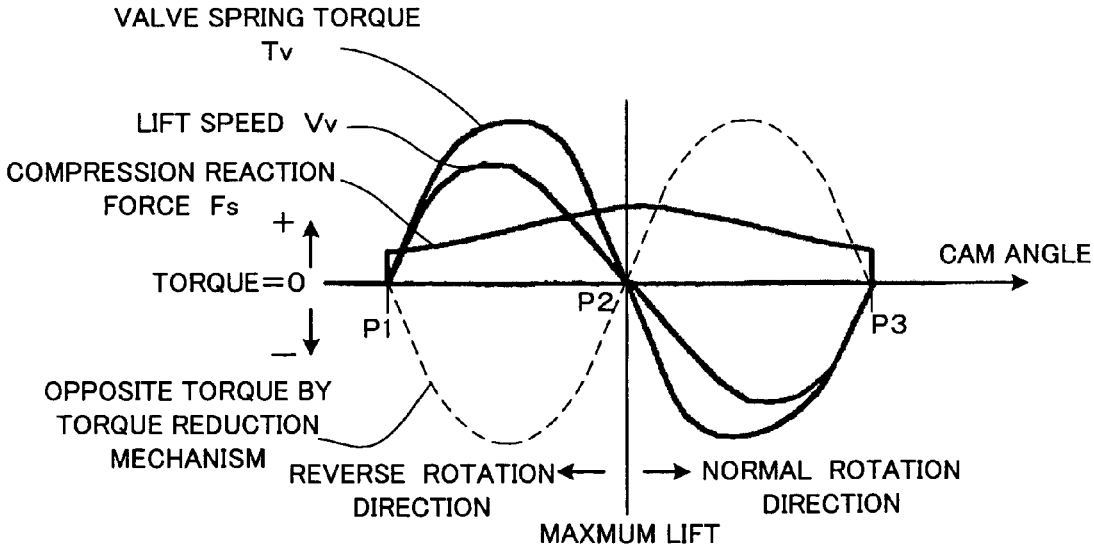
FIG. 5 is a view showing an example of a correlation between a cam angle and a valve spring torque.

A correlation, for example, shown in FIG. 5 is established between the compression reaction force Fs and the lift speed Vv, and the phase of the cam 21 (the cam angle). In this example, the compression reaction force Fs is shown by setting a direction of pressing back the intake valve 2 to a closed position to a positive direction, and the lift speed Vv is shown by setting a speed in a direction in which the intake valve 2 is operated in an opening direction to a positive direction. Further, the valve spring torque is shown by setting a torque in a direction of pressing back the cam 21 in an opposite direction to the rotational direction by the motor 21 to a positive direction. As shown in FIG. 5, the lift speed of the intake valve 2 starts ascending from a position P1 at which the lift (the opening operation) is started, and reaches in the middle of the lift. Further, the lift speed Vv is returned to 0 (zero) at a position P2 in a vertical axis in FIG. 5 where the maximum lift amount of the intake valve 2 is obtained, that is, a position where a leading end of the nose 21*a* of the cam 21 reaches a contact point with the cam follower 25, the lift speed Vv thereafter reaches a peak in a negative direction in the middle of the closing operation of the intake valve 2, and the lift speed Vv is returned to 0 (zero) at a position P3 where the intake valve 2 is completely closed. In this case, the changes in the lift speed Vv are equal to each other between two intake valves 2.

On the other hand, since the valve spring 28 is slightly compressed even in an initial state in which the intake valve 2 is completely closed, a compression reaction force Fs has a fixed initial value in a positive direction in the initial state. The compression reaction force Fs is gradually increased from the initial value after the position P1 at which the intake valve 2 is opened, and the compression reaction force Fs reaches a peak at the maximum lift position P2. The compression reaction force Fs is gradually reduced toward the initial value between the maximum lift position P2 and the position P3 at which the intake valve 2 is completely closed. A valve spring torque Tv as shown by a solid line in FIG. 5 is obtained by multiplying the lift speed Vv and the compression reaction force Fs together. A waveform of the valve spring torque Tv is a waveform in which the positive and negative peaks are deviated to the maximum lift position P2 in comparison with the waveform of the lift speed Vv.

In order to cancel the valve spring torque Tv applied to the cam mechanism 14, it is preferable to apply a complementary opposite torque having an opposite phase to the valve spring torque Tv shown by a broken line in FIG. 5 to the cam shaft 20 from the torque reduction mechanism 30. The opposite torque mentioned above is applied in a direction of pushing out the opposite phase cam 31 in the rotational direction thereof during a period (P1 to P2) that the cam 21 is positioned in a side that the cam 21 is pushed back in an opposite direction to the rotational direction based on the reaction force of the valve spring 28, in making the position P2 of the cam 21, at which the cam mechanism 14 applies a maximum lift amount to the intake valve 2, to be a boundary, while the opposite torque is applied in a direction of pushing back the opposite phase cam 31 in an opposite direction to the rotational direction during a period (P2 to P3) that the cam 21 is positioned in a side that the cam 21 is pushed out in the rotational direction based on the reaction force of the valve spring 28.

Sine the opposite torque applied by the torque reduction mechanism 30 can be obtained by a product of the compression reaction force of the spring 35 and the lift speed of the lifter 34, it is possible to determine the lift speed of the lifter 34 applied by the opposite phase cam 31, by first setting the compression reaction force of the spring 35 (a spring force) appropriately, and then dividing the torque of the opposite phase shown in FIG. 5 by the compression reaction force of the spring 35. Further, it is possible to acquire the lift amount of the opposite phase cam 31 with respect to the phase of the cam 21 by integrating the determined lift speed, and it is possible to determine a shape (a profile) of the cam surface 31*a* of the opposite phase cam 31 from the acquired lift amount. The profile of the cam surface 31*a* shown by the solid line in FIG. 4 can be obtained according to the procedure mentioned above.

Further, at the time of mounting the opposite phase cam 31 to the cam shaft 20, it is preferable to position the opposite phase cam 31 in a peripheral direction such that the lifter 34 exists at a lowest position of the back portion 31*c* of the cam surface 31*a* at the time when the lift amount of the intake valve 2 becomes maximum. It is possible to apply the torque canceling the valve spring torque Tv to the cam mechanism 14 from the torque reduction mechanism 30, by setting the profile of the opposite phase cam 31 and the mounting position in the peripheral direction with respect to the cam shaft 20. Accordingly, it is possible to reduce the output required for the motor 12, it is possible to restrict the electric power consumption of the motor 12, and it is possible to use the compact motor 12 having a small rated output.

In the valve gear 11A described above, the valve spring torque applied from each of the valve springs 28 of two intake valves 2 is canceled by the torque applied to the single opposite phase cam 31. Accordingly, at the time of designing the cam surface 31*a* of the opposite phase cam 31, a sum of the respective compression reaction forces of two valve springs 28 is used as the compression reaction force Fs.

The valve gear 11A for driving the intake valve is described above, however, with respect to the valve gear 11B for driving the exhaust valve 3, the torque reduction mechanism 30 can be provided in the same manner. In this case, when a plurality of cams 21 are provided in one cam shaft 20, single opposite cam 31 is provided in the cam shaft 20, or the same number of opposite phase cams 31 as that of the cam 21 is provided. In the valve gear 11B, when only one opposite phase cam 31 is provided with respect to a plurality of cams 21, the profile of the cam surface 31*a* is designed in the same manner as mentioned above such that the sum of the compression reaction forces of the respective valve springs 28 is set to the compression reaction force Fs. When the same number of opposite phase cams 31 as that of the cam 21 are provided on the cam shaft 20, the profile of the cam surface 31*a* of each of the opposite phase cam 31 is designed based on the compression reaction force of the valve spring 28 generating the valve spring torque to be cancelled by the opposite phase cam 31, and the lift speed of the exhaust valve 3.

Second Embodiment

Next, a description of the second embodiment according to the present invention will be given with reference to FIGS. 6 to 8. According to the second embodiment, the cam profile of the opposite phase cam 31 is designed while taking into consideration an inertia force of a reciprocating part at the time when the intake valve 2 or the exhaust valve 3 is driven so as to be opened and closed. In this case, the mechanical structure of the valve gears 11A and 11B is the same as the first embodiment.

In the case of opening and closing the intake valve 2 or the exhaust valve 3 via the cam mechanism 14, the rocker arm 24, the valve spring 28 and the like are reciprocated according to the motion of the valve 2 or 3, whereby the inertia force is generated, and the inertia torque is applied to the cam mechanism 14 in addition to the valve spring torque. When the rotational speed of the internal combustion engine is low, the inertia toque is sufficiently small in comparison with the valve spring torque based on the compression reaction force of the valve spring 28, however, particularly in the high rotation range, an influence of the inertia torque becomes comparatively great, and there is a case that a considerable influence is applied to the valve moving property of the intake valve 2 or the exhaust valve 3. Accordingly, in this embodiment, the shape of the cam surface 31*a* of the opposite phase cam 31 is designed while taking the inertia torque into consideration.

Figure 3:
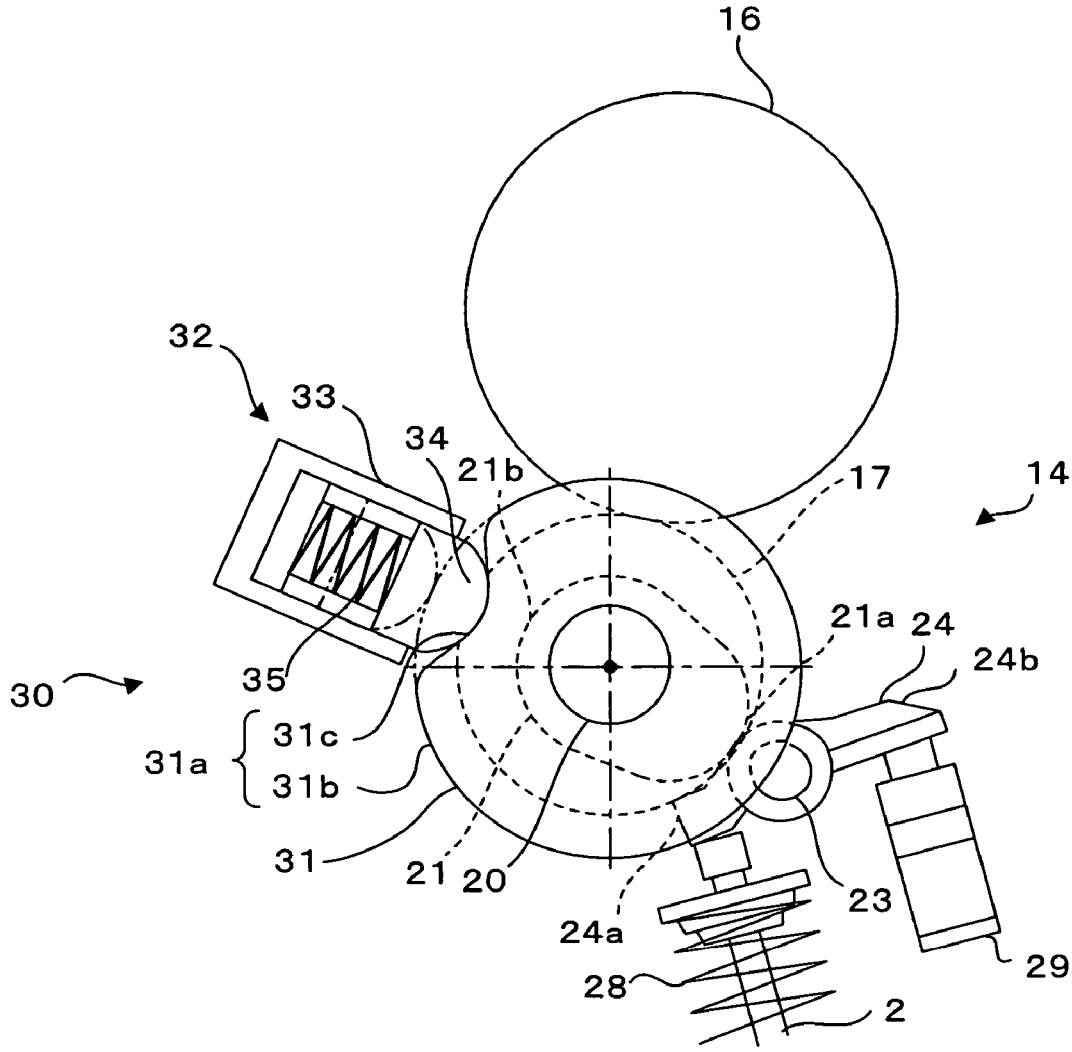
FIG. 3 is a view showing details of a torque reduction mechanism provided in the valve gear in FIG. 1.

The cam surface 31*a* of the opposite phase cam 31 taking the influence of the inertia torque into consideration is set, for example, to a profile shown by a broken line in FIG. 3, based on the valve spring torque and the inertia torque. The inertia toque Ta (N·m) can be calculated according to the following formula (2) on the assumption that the inertia force is set to Fa (N) and the lift speed of the cam 21 is set to Vv (m/rad).

$$Ta=Fa\times Vv \tag{2}$$

The inertia force Fa can be calculated according to the following formula (3) on the assumption that a valve side equivalent mass is set to We (kg), and an acceleration of the intake valve 2 or the exhaust valve 3 (a valve acceleration) is set to Va ($m/s^2$). In this case, since the valve acceleration is different in correspondence to the rotational speed of the internal combustion engine, the acceleration when the internal combustion engine is at the maximum rotation speed (for example, 6000 r.p.m.) is used. This is because the higher the rotational speed, the greater the influence of the inertia torque appears.

$$Fa=We\times Va \tag{3}$$

The valve side equivalent mass We is a total mass of the parts reciprocated by the cam mechanism 14, and, in the valve gear 11A in FIG. 1, is a sum of the respective masses of the intake valve 2, the valve spring 28, the rocker arm 24 and the like. The same matter is applied to the valve gear 11B in the exhaust side.

Figure 6A:
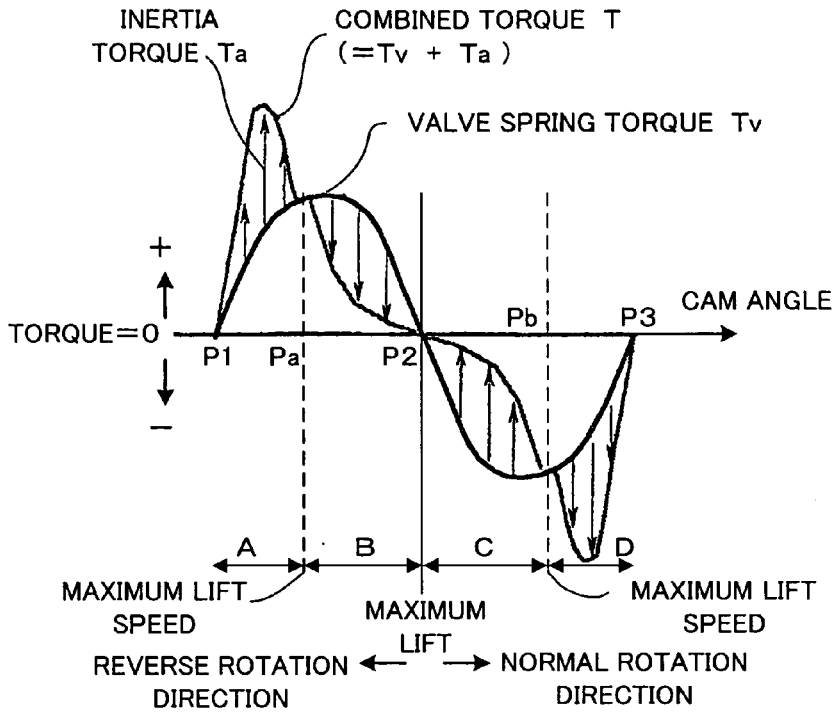
FIGS. 6A and 6B are views showing an example of a correlation between a cam angle and a combined torque in the case of taking an inertia torque into consideration.

A waveform of a combined torque T shown in FIG. 6A can be obtained by overlapping the inertia torque Ta and the valve spring torque Tv (the same as shown in FIG. 5) obtained without taking the influence of the inertia force Fa into consideration. The positions P1 to P3 in FIG. 6A are the same as those in FIG. 5, the position Pa shows a position at which the maximum lift speed in the opening direction is applied to the intake valve 2 or the exhaust valve 3, and the position Pb shows a position at which the maximum lift speed in the closing direction is applied to the intake valve 2 or the exhaust valve 3. The combined torque T forms a waveform in which an inertia torque Ta in a positive (+) direction is lapped over the waveform of the valve spring torque Tv in a range A between the positions P1 and Pa and in a range C between the positions P2 and Pb, and an inertia torque Tb in a negative (−) direction is lapped over the waveform of the valve spring torque Tv in a range B between the positions Pa and P2 and in a range D between the positions Pb and P3.

As is apparent from the formulae (2) and (3), a direction of the inertia torque Ta is determined based on a product of the lift speed Vv and the valve acceleration Va. The lift speed Vv (not shown) is a maximum value on a boundary (a left broken line in the drawing) between the ranges A and B in FIG. 6A, is approximately 0 (zero) on a boundary (a vertical axis in the drawing) between the ranges B and C, and is a minimum value on a boundary (a right broken line in the drawing) between the ranges C and D. On the other hand, the valve acceleration Va (not shown) obtained by differentiating the lift speed Vv is a positive value in the ranges A and D, and is a negative value in the ranges B and C. Accordingly, the product of the lift speed Vv and the valve acceleration Va is a positive value in the ranges A and C, and is a negative value in the ranges B and D, whereby the combined torque T shown in FIG. 6A is obtained.

Figure 6B:
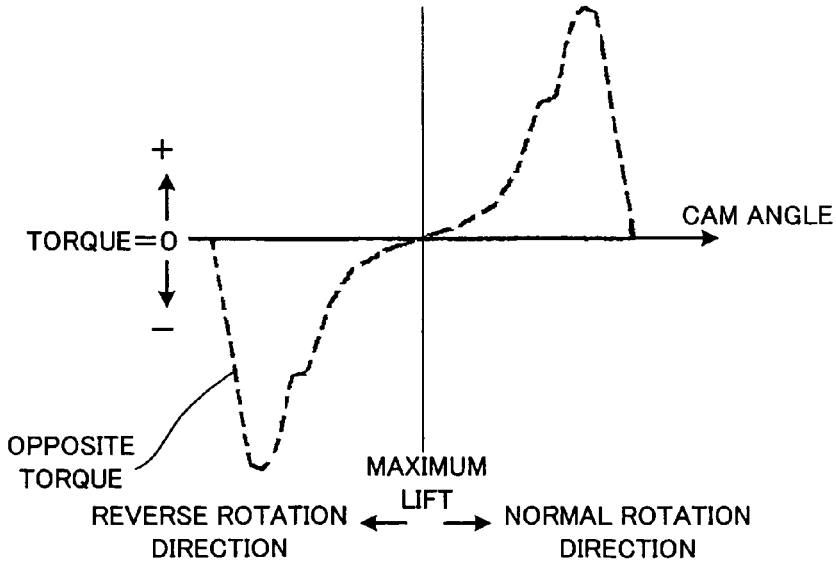

In order to cancel the combined torque T shown in FIG. 6A, it is preferable to apply the opposite torque of the opposite phase shown in FIG. 6B to the cam shaft 20 from the torque reduction mechanism 30. The opposite torque mentioned above has the following feature in comparison with the opposite torque (refer to the broken line in FIG. 5) required for canceling only the valve spring torque Tv mentioned above. In other words, the opposite torque in FIG. 6B is relatively larger than the opposite torque required for canceling only the valve spring torque during a period that the cam 21 is positioned in the range (P1 to P1 and Pb to P3) where the lift speed is increased, in making the position (the positions Pa and Pb in FIG. 6A) where the cam mechanism 14 applies the maximum lift speed to the intake valve 2 or the exhaust valve 3 to be a boundary, and is relatively smaller than the opposite torque required for canceling only the valve spring torque Tv during a period that the cam 21 is positioned in the range (Pa to P2 and P2 to Pb) where the lift speed is reduced.

In order to determine the profile of the cam surface 31*a* of the opposite phase cam 31 based on the opposite torque in FIG. 6B, the lift speed of the lifter 34 applied by the opposite phase cam 31 can be obtained by appropriately setting the compression reaction force of the spring 35 in the same manner as the first embodiment and dividing the opposite phase torque shown in FIG. 6B by the set compression reaction force. The lift amount of the opposite phase cam 31 in correspondence to each of the phases of the cam 21 can be acquired by integrating the lift speed, and it is possible to determine the profile of the opposite phase cam 31.

Figure 7A:
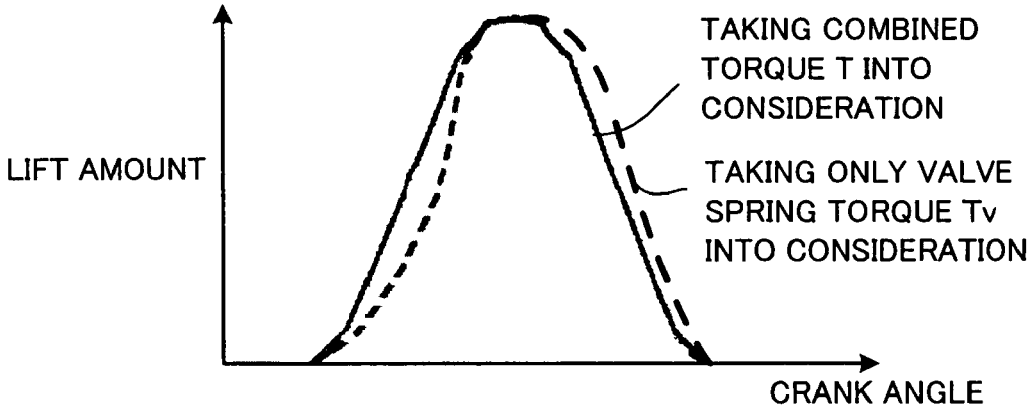
FIGS. 7A and 7B are views showing an example of a correlation between a crank angle and a lift amount of an intake valve or an exhaust valve in the case of applying the opposite phase torque while taking the inertia torque into consideration.
Figure 7B:
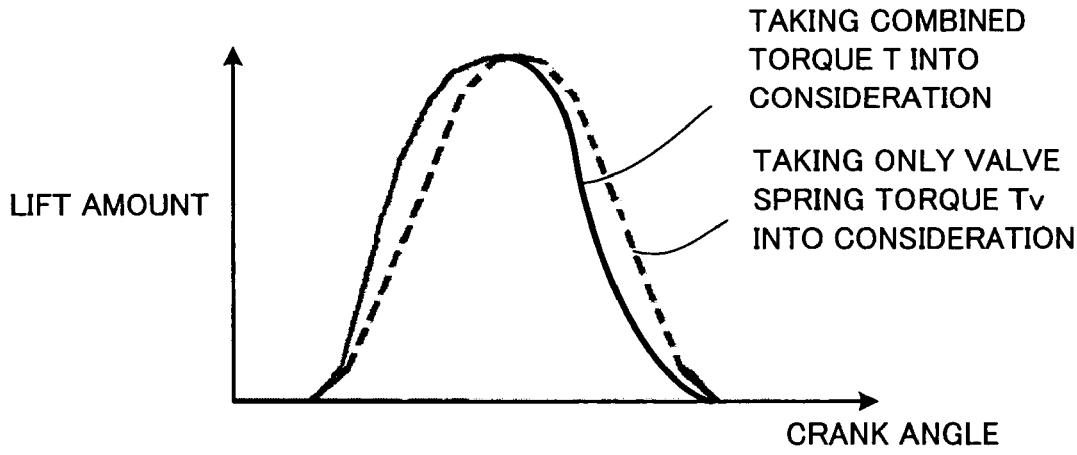
Figure 8:
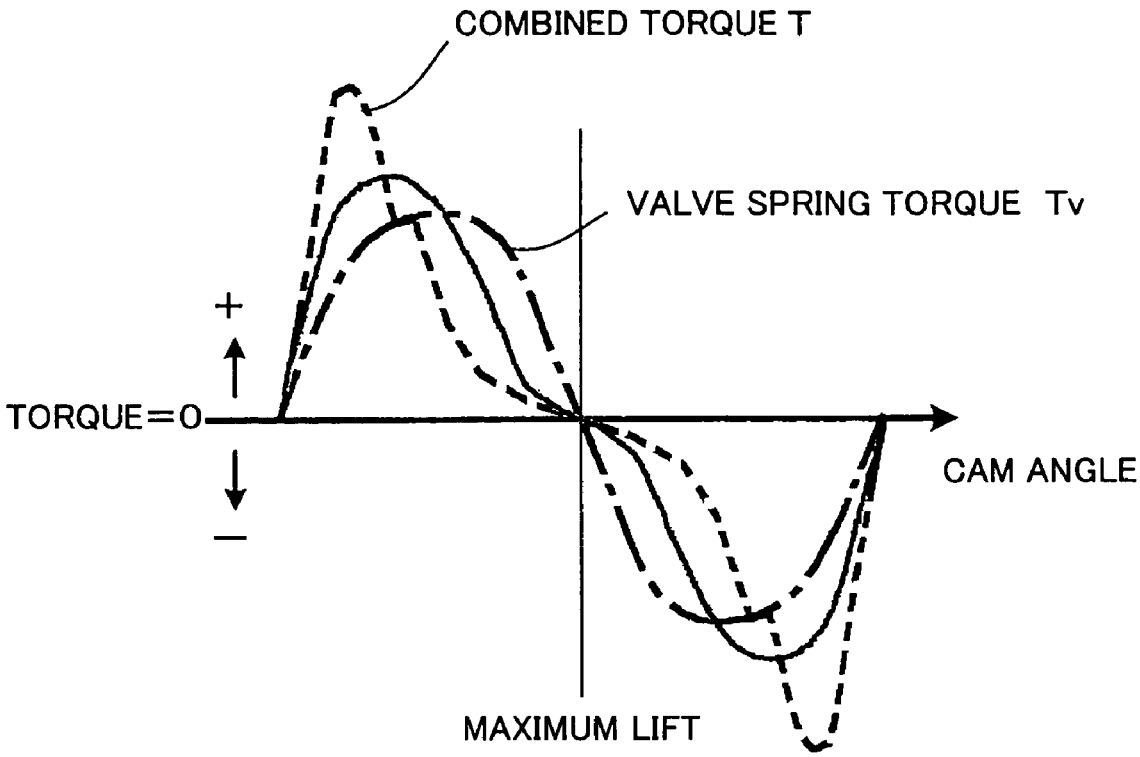
FIG. 8 is a view showing an example of a correlation between a cam angle and a torque in the case of setting the opposite phase torque to an intermediate value between the valve spring torque and the combined torque.

As mentioned above, when the profile of the opposite phase cam 31 is designed while taking the inertia torque into consideration, the lift property of the intake valve 2 or the exhaust valve 3 as shown in FIGS. 7A and 7B can be obtained. A horizontal axis of the lift shape indicates a crank angle, and a vertical axis indicates a lift amount, respectively. FIG. 7A shows the lift property in the high speed rotation range of the internal combustion engine, and FIG. 7B shows the lift property in the low speed rotation range, respectively. In FIGS. 7A and 7B, a solid line shows the lift property of the intake valve 2 or the exhaust valve 3 by the opposite phase cam 31 while taking the combined torque T into consideration, and a broken line shows the lift property of the intake valve 2 or the exhaust valve 3 by the opposite phase cam 31 without taking the inertia torque into consideration, respectively.

As shown by the broken line in FIG. 7A, in the opposite phase cam 31 while taking only the valve spring torque Tv into consideration, since the torque applied to the cam shaft 20 from the torque reduction mechanism 30 is short, there is a tendency that the rotation of the motor 12 is delayed and a rise of the lift amount is delayed. On the contrary, the delay of the rise of the lift amount can be canceled by the opposite phase cam 31 while taking the inertia torque Ta into consideration (the solid line in FIG. 7A). Accordingly, it is possible to increase an area surrounded by the lift shape and the horizontal axis, that is, a so-called time area, and it is possible to operate the intake valve 2 or the exhaust valve 3 according to an intended property so as to improve a control accuracy thereof. Further, as shown by the solid line in FIG. 7B, according to the opposite phase cam 31 while taking the inertia torque Ta into consideration, it is possible to increase the time area by applying the motor torque even in the low speed rotation range, and it is possible to sufficiently intake or exhaust from the intake valve 2 or the exhaust valve 3.

In this case, when the opposite phase cam 31 is designed in conformity with the inertia torque at the time when the internal combustion engine is operated at the maximum speed, the torque fluctuation is increased with respect to the change of the cam angle (the phase), and there is a tendency that a radius of curvature of the cam surface 31*a* in the opposite phase cam 31 becomes small. However, there is a possibility that the cam surface 31*a* having the small radius of curvature can not be formed due to a design restriction. In this case, the profile of the opposite phase cam 31 may be set based on an intermediate torque property (a solid line in FIG. 8) between a combined torque T (a broken line in FIG. 8) and a valve spring torque Tv (a one-dot chain line in FIG. 8). Accordingly, it is possible to avoid the matter that the radius of curvature of the profile of the opposite phase cam 31 becomes extremely small, and it is possible to satisfy the design restriction while taking the inertia torque Ta into consideration.

The prevent invention can be carried out according to various aspects without being limited to the embodiments mentioned above. The structure of the torque reduction mechanism 30 corresponds to one example, and can be modified variously. The torque reduction mechanism 30 is not limited to the embodiment in which the torque reduction mechanism is coaxially arranged with the cam shaft 20, but can be structured as far as the torque can be applied at any position in a rotation transfer path from the motor 12 to the cam shaft 20. For example, the opposite phase cam 31 is provided on the same axis as the intermediate gear 16 provided between the motor gear 15 and the drive gear 17. Alternatively, a shaft rotating in a state of being meshed with the cam shaft 20 may further be added to the outside of the rotation transfer path from the motor 12 to the cam shaft 20, and the opposite phase cam 31 may be provided on the shaft. In this case, it is necessary that the shaft to be provided with the opposite phase cam 31 of the torque reduction mechanism 30 rotates at a rotational speed which is 1/N (where N is an integral number) with respect to the rotational speed of the cam shaft 20. Since the cycle of the valve spring torque and the inertia torque which are applied to the cam shaft 20 is fluctuated at the same cycle as that of the opening and closing motion of the cam shaft 20, it is necessary to establish a relation that the cam shaft 20 is rotated at a speed which is integral multiple of that of the opposite phase cam 31, in order to change the opposite phase torque from the torque reduction mechanism 30 at the same cycle as that of the torque. When the opposite phase cam 31 is rotated at a uniform speed with the cam shaft 20, it is preferable to set the profile of the cam surface 31*a* by matching one circuit of the opposite phase cam 31 with one circuit of the cam 21. However, when the opposite phase cam 31 is rotated at a lower speed than that of the cam shaft 20, that is, when a relation $N \geqq 2$ is established, it is preferable to determine the profile of the opposite phase cam 31 by matching 1/N circuit of the opposite phase cam 31 with one circuit of the cam 21. For example, in the case of N=3, the profile corresponding to the opposite torque shown in FIG. 5 or 6B is provided in the opposite phase cam 31 repeatedly at three times in a peripheral direction.

Figure 9:
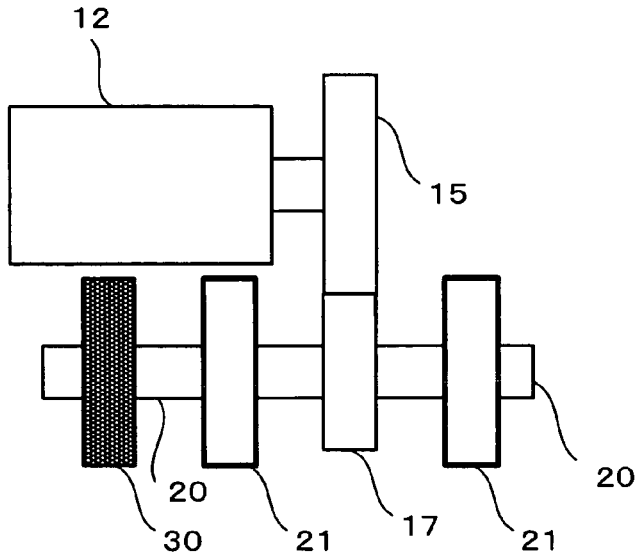
FIG. 9 is a view showing an example of an arrangement of the opposite phase cam.

In FIG. 2, one torque reduction mechanism 30 is provided in two intake valves 2 of one cylinder 1, however, the torque reduction mechanism 30 may be separately provided in each of the intake valves 2. Even when a plurality of exhaust valves or intake valves are independently driven by a plurality of different cams as in the valve gear 11B in the exhaust side, one torque reduction mechanism 30 may be provided in two cams 21 as shown in FIG. 9. When the torque reduction mechanism 30 is commonly used between a plurality of cams as mentioned above, it is possible to shorten the length of the cam shaft 20 with respect to an axial direction in comparison with the case that the torque reduction mechanism is provided in each of the cams, and it is possible to reduce the limit with respect to the placing space of the valve gears 11A or 11B.

Figure 10:
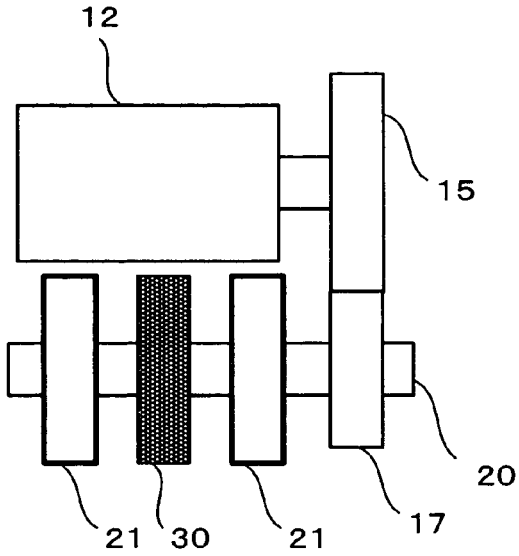
FIG. 10 is another example of the arrangement of the opposite phase cam.

When one torque reduction mechanism 30 is provided for a plurality of cams 21, the opposite phase cam 31 of the torque reduction mechanism 30 may be arranged between the cams 21 as shown in FIG. 10. In this case, it is possible to reduce the torque loaded by the cam shaft 20 between the torque reduction mechanism 30 and the cam 21 in comparison with the structure in FIG. 9 so as to make an axial diameter of the cam shaft 20 small. When the axial diameter of the cam shaft 20 becomes small, an inertia moment of the cam shaft 20 is reduced, so that a response of the motor 12 can be improved.

Figure 11A:
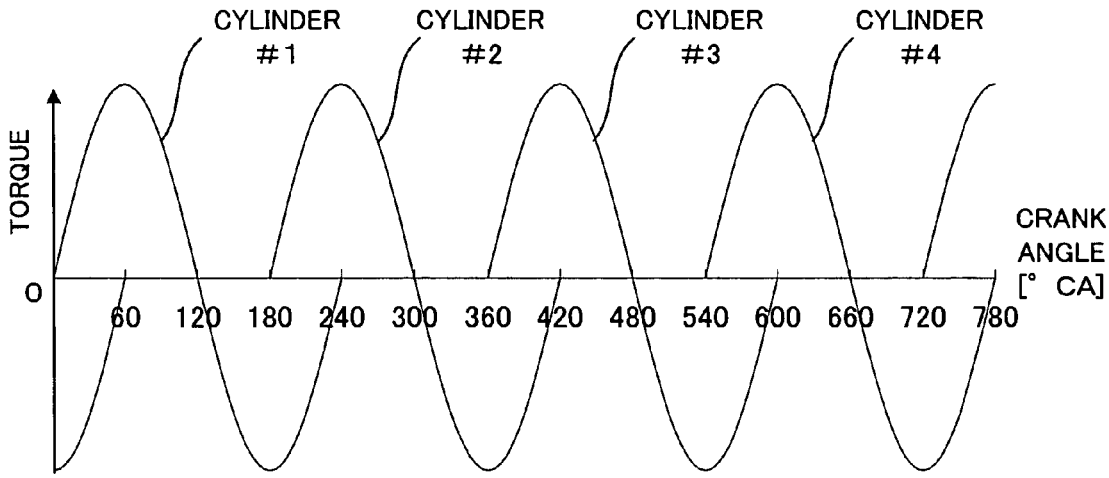
FIGS. 11A and 11B are views showing a waveform of the combined torque when a cam shaft is commonly used in a plurality of cylinders.
Figure 11B:
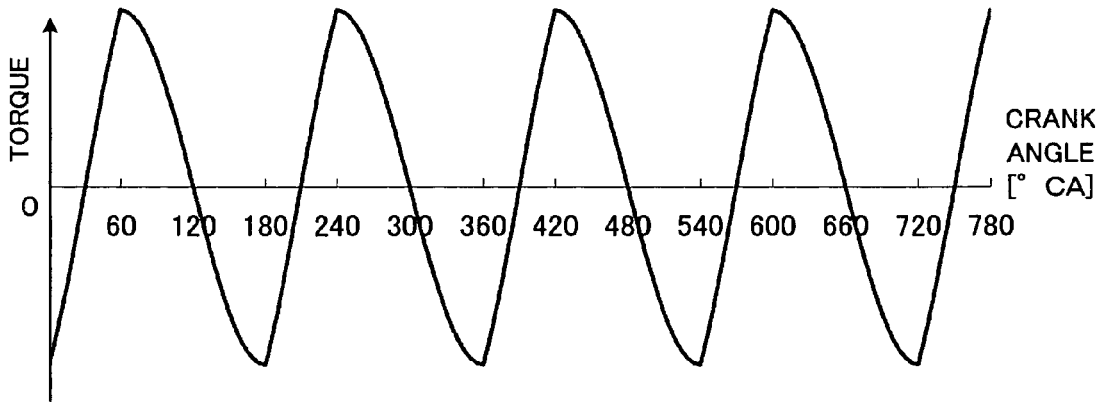

The present invention is not limited to the example in which the valve gears 11A or 11B are provided in each of the cylinders 1. The cam shaft 20 may be commonly used between a plurality of cylinders 1, and one torque reduction mechanism 30 may be provided in one cam shaft 20. When the cam shaft 20 is provided over a plurality of cylinders, the phase of the cam 21 is shifted per the cylinder 1. Accordingly, it is necessary to determine the cam profile of the opposite phase cam 31 based on the torque obtained by combining the valve spring torque and the inertia torque per of the cylinders applied to the cam shaft 20. For example, when the cam shaft 20 is commonly used between all the cylinders 1 in the four-cylinder internal combustion engine which achieves even firing, the torque corresponding to each of the cylinders 1 is applied to the cam shaft 20 while being shifted at a crank angle of 180 degree as shown in FIG. 11A. Accordingly, it is preferable to set the profile of the opposite phase cam 31 based on the combined torque shown in FIG. 11B and obtained by combining these waveforms.

Further, when one torque reduction mechanism 30 is provided for a plurality of intake valves 2 or exhaust valves 3, it is desirable to make the compression reaction force of the spring 35 in the torque reduction mechanism 30 equal to the product of the compression reaction force of one valve spring 28 and the number of the intake valve 2 or the exhaust valve 3. By setting the compression reaction force of the spring 35 in the torque reduction mechanism 30 in the manner mentioned above, it is possible to bring the lift property of the intake valve 2 or the exhaust valve 3 applied by the opposite phase cam 31 and the cam 21 into line with each other. Accordingly, it is possible to set the profile of the opposite phase cam 31 based on the smooth profile of the cam 21, and there is no risk that the radius of curvature of the opposite phase cam 31 is extremely reduced.

What is claimed is:

1. A valve gear of an internal combustion engine, comprising:

a cam mechanism for converting rotational motion of an electric motor into linear motion to drive a valve for opening and closing a cylinder against a valve spring; and a torque reduction mechanism for adding an opposite torque, which serves so as to reduce a torque applied to the cam mechanism from the valve spring at the time of driving the valve, to the cam mechanism, wherein the torque reduction mechanism comprises an opposite phase cam which rotates in an interlocking manner at a rotational speed of 1/N (where N is an integral number) times of the rotational speed of a cam in the cam mechanism and has a cam surface formed on a surface thereof, a cam holding member which is in contact with the cam surface, and an urging member which urges the cam holding member toward the cam surface of the opposite phase cam, and an outline of the cam surface in the opposite phase cam is set such that an opposite torque canceling a valve spring torque applied to the cam mechanism based on the reaction force of the valve spring is applied to the opposite phase cam from the urging member.

2. The valve gear according to claim 1, wherein the outline of the cam surface in the opposite phase cam is set such that the opposite torque applied from the urging member is applied in a direction of pushing out the opposite phase cam in the rotational direction during a period that the cam of the cam mechanism is positioned in a side that the cam is pushed back in an opposite direction to the rotational direction based on the reaction force of the valve spring, in making a position in the peripheral direction of the cam in the cam mechanism, at the time when the cam mechanism applies a maximum lift amount to the valve, to be a boundary, while the opposite torque is applied in a direction of pushing back the opposite phase cam in an opposite direction to the rotational direction during a period that the cam of the cam mechanism is positioned in a side that the cam is pushed out in the rotational direction based on the reaction force of the valve spring.

3. The valve gear according to claim 1, wherein a plurality of intake or exhaust valves are provided for one cylinder of the internal combustion engine, a plurality of cams for driving the valves of the same cylinder are provided so as to rotatably be driven by a common cam shaft, and the opposite phase cam is commonly provided for the cams.

4. The valve gear according to claim 3, wherein the opposite phase cam is arranged between the cams.

5. The valve gear according to claim 1, wherein the cam surface of the opposite phase cam is provided with a circular arc portion which is extended while drawing a circular arc having a fixed radius and being coaxial with a cam shaft, and a back portion which is backed to a center side from the circular arc portion.

6. A valve gear of an internal combustion engine, comprising:

a cam mechanism for converting rotational motion of an electric motor into linear motion to drive a valve for opening and closing a cylinder against a valve spring; and a torque reduction mechanism for adding an opposite torque, which serves so as to reduce a torque applied to the cam mechanism from the valve spring at the time of driving the valve, to the cam mechanism, wherein the torque reduction mechanism comprises an opposite phase cam which rotates in an interlocking manner at a rotational speed of 1/N (where N is an integral number) times of the rotational speed of a cam in the cam mechanism and has a cam surface formed on a surface thereof, a cam holding member which is in contact with the cam surface, and an urging member which urges the cam holding member toward the cam surface of the opposite phase cam, and an outline of the cam surface in the opposite phase cam is set such that an opposite torque canceling a combined torque obtained by combining a valve spring torque applied to the cam mechanism based on the reaction force of the valve spring and an inertia torque applied to the cam mechanism according to motion of the valve is applied to the opposite phase cam from the urging member.

7. The valve gear according to claim 6, wherein the outline of the cam surface in the opposite phase cam is set such that the opposite torque applied from the urging member is applied in a direction of pushing out the opposite phase cam in the rotational direction during a period that the cam of the cam mechanism is positioned in a side that the cam is pushed back in an opposite direction to the rotational direction based on the reaction force of the valve spring, in making a position in the peripheral direction of the cam in the cam mechanism, at the time when the cam mechanism applies a maximum lift amount to the valve, to be a boundary, while the opposite torque is applied ma direction of pushing back the opposite phase cam in an opposite direction to the rotational direction during a period that the cam of the cam mechanism is positioned in a side that the cam is pushed out in the rotational direction based on the reaction force of the valve spring, and such that the opposite torque relatively larger than the opposite torque required for canceling only the valve spring torque is applied to the opposite phase cam during a period that the cam of the cam mechanism is positioned in a range that the lift speed is increased, in making a position where the cam mechanism applies a maximum lift speed to the valve to be a boundary, while the opposite torque relatively smaller than the opposite torque required for canceling only the valve spring torque is applied to the opposite phase cam during a period that the cam of the cam mechanism is positioned in a range that the lift speed is reduced.

8. The valve gear according to claim 6, wherein a plurality of intake or exhaust valves are provided for one cylinder of the internal combustion engine, a plurality of cams for driving the valves of the same cylinder are provided so as to rotatably be driven by a common cam shaft, and the opposite phase cam is commonly provided for the cams.

9. The valve gear according to claim 8, wherein the opposite phase cam is arranged between the cams.

10. The valve gear according to claim 6, wherein the cam surface of the opposite phase cam is provided with a circular arc portion which is extended while drawing a circular arc having a fixed radius and being coaxial with a cam shaft, and a back portion which is backed to a center side from the circular arc portion.

* * * * *